US005919595A

United States Patent [19]

Mychajlowskij et al.

[11] Patent Number: 5,919,595

[45] Date of Patent: Jul. 6, 1999

[54] TONER PROCESS WITH CATIONIC SALTS

[75] Inventors: Walter Mychajlowskij, Mississauga; Daniel A. Foucher, Toronto; Guerino G. Sacripante; Raj D. Patel, both of Oakville; Beng S. Ong, Mississauga, all of Canada

[73] Assignee: Xerox Corporation, Stamford, Conn.

[21] Appl. No.: 09/006,553

[22] Filed: Jan. 13, 1998

[51] Int. Cl.[6] ..... G03G 9/087

[52] U.S. Cl. ..... 430/137; 430/106

[58] Field of Search ..... 430/137, 106

[56] References Cited

U.S. PATENT DOCUMENTS

| | | | |
|---|---|---|---|
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,660,965 | 8/1997 | Mychajlowskij et al. | 430/137 |
| 5,840,462 | 11/1998 | Foucher et al. | 430/137 |

*Primary Examiner*—John Goodrow
*Attorney, Agent, or Firm*—E. O. Palazzo

[57] ABSTRACT

A process for the preparation of toner comprising mixing an emulsion latex, a colorant dispersion, and monocationic salt, and which mixture possesses an ionic strength of from about 0.001 molar (M) to about 5 molar, and optionally cooling.

30 Claims, No Drawings

TONER PROCESS WITH CATIONIC SALTS

PENDING APPLICATIONS

The following copending applications, the disclosures of which are totally incorporated herein by reference, are being filed concurrently herewith.

U.S. Pat. No. 5,840,462 discloses a toner process wherein a colorant is flushed into a sulfonated polyester, followed by the addition of an organic soluble dye and an alkali halide solution.

U.S. Pat. No. 5,853,944 discloses a toner process with a first aggregation of sulfonated polyester, and thereafter, a second aggregation with a colorant dispersion and an alkali halide.

U.S. Ser. No. 09/006,640 discloses a toner process wherein a latex emulsion and a colorant dispersion are mixed in the presence of an organic complexing agent or compound, and wherein the latex can contain a sodio sulfonated polyester resin.

U.S. Ser. No. 09/006,521 discloses an emulsion/aggregation/fusing process for the preparation of a toner containing a resin derived from the polymerization of styrene butadiene, acrylonitrile, and acrylic acid.

U.S. Ser. No. 09/006,299 discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

U.S. Pat. No. 5,869,215 discloses a toner process by blending an aqueous colorant dispersion with a latex blend containing a linear polymer and soft crosslinked polymer particles.

U.S. Pat. No. 5,869,216 discloses a toner process wherein there is mixed an aqueous colorant dispersion and an emulsion latex, followed by filtering, and redispersing the toner formed in water at a pH of above about 7 and contacting the resulting mixture with a metal halide or salt and then with a mixture of an alkaline base and a salicylic acid, a catechol, or mixtures thereof.

Illustrated in U.S. Pat. No. 5,593,807, the disclosure of which is totally incorporated herein by reference in its entirety, is a process for the preparation of toner compositions comprising preparing an emulsion latex comprised of sodio sulfonated polyester resin particles of from about 5 to about 500 nanometers in size diameter by heating the resin in water at a temperature of from about 65° C. to about 90° C.; preparing a colorant dispersion by dispersing in water from about 10 to about 25 weight percent of the sodio sulfonated polyester and from about 1 to about 5 weight percent of colorant; adding the colorant dispersion to the latex mixture, followed by the addition of an alkali halide, such as calcium chloride, in water until aggregation results as indicated by an increase in the latex viscosity of from about 2 centipoise to about 100 centipoise; heating the resulting mixture at a temperature of from about 45° C. to about 80° C. thereby causing further aggregation and enabling coalescence, resulting in toner particles of from about 4 to about 9 microns in volume average diameter and with a geometric distribution of less than about 1.3; and optionally cooling the product mixture to about 25° C. and thereafter washing and drying. The process of this patent may be disadvantageous in that, for example, the dicationic alkali metal selected may result in a final toner resin which evidences some crosslinking or elastic reinforcement primarily since the metal salt functions as a crosslinked site between the sulfonate groups contained on the polyester resin, causing an increase in viscosity and a decrease, or loss of low gloss characteristics for the polyester resin. These and other disadvantages and problems are minimized, or avoided with the processes of the present invention. Also, with the present invention there is enabled a continuous process and the continuous growth of submicron polyester particles from the about 20 to 30 nanometers range to toner sized particles of from about 3 to about 10 microns in volume average diameter as determined by known methods, such as a Coulter Counter, and which processes can select controlled increases in the ionic strength.

The appropriate components and processes of the copending applications may be selected for the present invention in embodiments thereof.

BACKGROUND OF THE INVENTION

The present invention is generally directed to toner processes, and more specifically, to aggregation and coalescence processes for the preparation of toner compositions. In embodiments, the present invention is directed to the economical chemical in situ preparation of toners without the utilization of the known toner pulverization and/or classification methods, and wherein in embodiments toner compositions with a volume average diameter of from about 1 to about 25, and preferably from 1 to about 10 microns and narrow GSD of, for example, from about 1.14 to about 1.26 as measured on the Coulter Counter can be obtained. The resulting toners can be selected for known electrophotographic imaging, printing processes, including color processes, and lithography.

In reprographic technologies, such as xerographic and ionographic devices, toners with volume average diameter particle sizes of from about 9 microns to about 20 microns are effectively utilized. Moreover, in a number of xerographic technologies, such as the high volume Xerox Corporation 5090 copier-duplicator, high image resolution characteristics and low image noise are highly desired, and this can be attained utilizing the small sized toners of the present invention with, for example, a volume average particle of from about 2 to about 11 microns and preferably less than about 7 microns, and with narrow geometric size distribution (GSD) of from about 1.16 to about 1.3. Additionally, in xerographic systems wherein process color is utilized, such as pictorial color applications, small particle size colored toners, preferably of from about 3 to about 9 microns, are needed to avoid paper curling. Paper curling is especially observed in pictorial or process color applications wherein three to four layers of toners are transferred and fused onto paper. During the fusing step, moisture is driven off from the paper due to the high fusing temperatures of from about 130° C. to 160° C. applied to the paper from the fuser. Where only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. These and other disadvantages and problems are avoided or minimized with the toners and processes of the present invention. Toners prepared in accordance with the present invention enable in embodiments the use of lower image fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications, and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns, and fixing thereafter results in a low gloss toner image of from about 1 to about 30 gloss units as measured by the Gardner Gloss metering unit. Alternatively, when higher image gloss is desired, such as from about 31 to about 60 gloss units as measured by the Gardner Gloss metering unit, higher gloss paper is utilized, such as from is about 31 to about 60 gloss units, and which after image formation with small particle size toners of the present invention of preferably from about 3 to about 5 microns, and fixing thereafter results in a higher gloss toner image of from about 31 to about 60 gloss units as measured by the Gardner Gloss metering unit. The aforementioned toner to paper matching can be attained with small particle size toners, such as less than 7 microns and preferably less than 5 microns, such as from about 1 to about 4 microns, whereby the pile height of the toner layer or layers is considered low and acceptable. Moreover, it is preferable to select small toner particle sizes, such as from about 1 to about 7 microns, and with higher pigment loading, such as from about 5 to about 12 percent by weight of toner, so that the mass of toner layers deposited onto paper is reduced to obtain the same quality of image and resulting in a thinner plastic toner layer on paper after fusing, thereby minimizing or avoiding paper curling.

Numerous processes are known for the preparation of toners, such as, for example, conventional processes wherein a resin is melt kneaded or extruded with a pigment, micronized and pulverized to provide toner particles with a volume average particle diameter of from about 9 microns to about 20 microns and with broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 3 microns to about 9 microns, and preferably 5 microns are attained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments of the present invention. In addition, by the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. The disadvantage, for example, of poor GSD requires classification resulting in low toner yields, reference for example U.S. Pat. No. 4,797,339, wherein there is disclosed a process for the preparation of toners by resin emulsion polymerization, wherein similar to the '127 patent certain polar resins are selected; and U.S. Patent 4,558,108, wherein there is disclosed a process for the preparation of a copolymer of styrene and butadiene by specific suspension polymerization.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites.

Emulsion/aggregation/coalescing processes for the preparation of toners are illustrated in a number of Xerox Corporation patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners). The appropriate components and processes of the Xerox patents may be selected for the present invention in embodiments thereof.

SUMMARY OF THE INVENTION

It is a feature of the present invention to provide toner processes with many of the advantages illustrated herein.

In another feature of the present invention there are provided simple and economical processes for the direct preparation of black and colored toner compositions with, for example, excellent colorant, such as pigment dispersion and narrow GSD, and wherein there is selected monocationic salts, such as sodium chloride, sodium bromide, sodium iodide, potassium chloride, potassium bromide, and the like. In a further feature of the present invention there are provided simple and economical in situ surfactant free processes for black and colored toner compositions by an emulsion aggregation process, and wherein a sulfonated polyester is selected as the resin, reference copending patent application U.S. Ser. No. 221,595, the disclosure of which is totally incorporated herein by reference.

Moreover, in a further feature of the present invention there is provided a process of preparing in situ polyester toner wherein the monocationic salt concentration and the temperature of aggregation and coalescence determines the final toner particle size obtained.

Also, in a further feature of the present invention there is provided a process for the preparation of sulfonated polyester containing toner compositions with an average particle volume diameter of from between about 1 to about 20 microns, preferably from about 1 to about 10 microns, and more preferably 2 to 9 microns in volume average diameter, and with a narrow GSD of from about 1.12 to about 1.35, and preferably from about 1.14 to about 1.26 as measured by a Coulter Counter.

In a further feature of the present invention there is provided a process for the preparation of toner compositions with certain effective particle sizes by controlling the temperature of the aggregation which comprises stirring and heating about below the resin glass transition temperature (Tg).

Additionally, in a further feature of the present invention there is provided a process for the preparation of toners in which the aggregation and coalescence is accomplished simultaneously and at the same temperature, and wherein the temperature is from about 45° C. to about 60° C. or from about 2° C. to about 8° C. below the latex resin Tg.

Moreover, in a further feature of the present invention there is provided an economical process for the preparation of toner compositions which after fixing to paper substrates results in images with a gloss of from 20 GGU (Gardner Gloss Units) up to 70 GGU as measured by Gardner Gloss meter matching of toner and paper.

In another feature of the present invention there is provided a composite toner of polymeric resin with colorant and optional charge control agent in high yields of from about 90 percent to about 100 percent by weight of toner without resorting to classification and wherein surfactants are avoided; and wherein toners can be directly obtained from polyester emulsions of a size diameter of about 20 to about 30 nanometers, and wherein unwanted flocculation or aggregation is avoided, or minimized.

The present invention relates to a process for the preparation of toner comprising mixing an emulsion latex, a colorant dispersion, and monocationic salt, and which mixture possesses an ionic strength of from about 0.001 molar (M) to about 5 molar, and optionally cooling; a process wherein the latex contains a sodio sulfonated polyester resin of from about 5 to about 500 nanometers in size diameter, a solution of the monocationic salt is added to the latex and colorant mixture, and cooling is accomplished; a process wherein the emulsion latex contains a resin, and which latex is prepared by heating the resin in water at a temperature of from about 65° C. to about 90° C.; thereafter there is added the colorant dispersion with shearing, followed by the addition to the resulting mixture of the monocationic salt until there results an increase in the latex viscosity of from about 2 centipoise to about 100 centipoise, and which mixture possesses an ionic strength of from about 0.001 to about 5 M; heating the resulting mixture of the latex and the colorant dispersion at a temperature of from about 45° C. to about 80° C. thereby enabling the simultaneous aggregation and coalescence of particles of resin and colorant resulting in toner of from about 2 to about 20 microns in volume average diameter with the size of the toner being retained upon quenching, or cooling the product mixture to about 25° C. followed by filtration and drying; a process wherein the salt selected is sodium chloride, potassium chloride, sodium bromide, or potassium bromide; a process wherein the ionic strength of the monocationic salt and the temperature of the aggregation/coalescence controls the final toner particle size, and which size is from about 4 to about 9 microns, and wherein shearing is completed by homogenizing at from about 1,000 revolutions per minute to about 10,000 revolutions per minute, at a temperature of from about 25° C. to about 35° C., and for a duration of from about 1 minute to about 120 minutes; a process wherein the colorant dispersion is generated by microfluidization in a microfluidizer, or in nanojet for a duration of from about 1 minute to about 120 minutes; a process wherein shearing or homogenization is accomplished by homogenizing at from about 1,000 revolutions per minute to about 10,000 revolutions per minute for a duration of from about 1 minute to about 120 minutes; a process wherein the emulsion latex contains a resin of (i) a polyester of poly(1,2-propylene-sodio 5-sulfoisophthalate), poly(neopentylene-sodio 5-sulfoisophthalate), poly(diethylene-sodio 5-sulfoisophthalate), copoly (1,2-propylene-sodio 5-sulfoisophthalate)-copoly-(1,2-propylene-terephthalatephthalate), copoly(1,2-propylene-diethylene-sodio 5-sulfoisophthalate)-copoly-(1,2propylene-diethylene-terephthalatephthalate), copoly-(ethyleneneopentylene-sodio 5-sulfoisophthalate)-copoly-(ethylene-neopentyleneterephthalate-phthalate), or copoly (propoxylated bisphenol A)-copoly-(propoxylated bisphenol A-sodio 5-sulfoisophthalate); and wherein the salt is sodium chloride, potassium chloride, sodium bromide, or potassium bromide; a process wherein the emulsion latex contains a resin of (i) a polyester of poly(1,2-propylene-sodio 5-sulfoisophthalate), poly(neopentylene-sodio 5-sulfoisophthalate), poly(diethylene-sodio 5-sulfoisophthalate), copoly(1,2propylene-sodio 5-sulfoisophthalate)-copoly-(1,2-propylene-terephthalatephthalate), copoly(1,2-propylene-diethylene-sodio 5-sulfoisophthalate)-copoly-(1,2-propylene-diethylene-terephthalate phthalate), copoly(ethylene-neopentylene-sodio 5-sulfoisophthalate)-copoly(ethylene-neopentylene-terephthalate-phthalate), or copoly (propoxylated bisphenol A)-copoly-(propoxylated bisphenol A-sodio 5-sulfoisophthalate); a process wherein the colorant is carbon black, cyan, yellow, magenta, and mixtures thereof; a process wherein the resin is from about 0.01 to about 0.2 micron in volume average diameter, and the colorant in the form of particles is from about 0.01 to about 500 nanometers in volume average diameter; a process wherein the toner particles isolated are from about 2 to about 15 microns in volume average diameter, and the geometric size distribution thereof is from about 1.15 to about 1.35; a process wherein there is added to the surface of the formed toner metal salts, metal salts of fatty acids, silicas, metal oxides, inclusive of titanium oxides, tin oxides or mixtures thereof, each in an amount of from about 0.1 to about 10 weight percent of the obtained toner particles; a process wherein the toner obtained after quenching is from about 3 to about 15 microns in volume average diameter, and the geometric size distribution thereof is from about 1.15 to about 1.30; a process wherein the resin Tg is from about 50° C. to about 65° C.; a process for the preparation of toner comprising mixing an emulsion latex comprised of sodio sulfonated polyester resin particles of less than about 0.1 micron in size diameter, and which emulsion can be generated by heating the resin particles in water at a temperature of from about 15° C. to about 30° C. above the resin glass transition temperature, and a colorant dispersion followed by the addition of a monoatomic halide of from about 1 to about 2 weight percent in water until a slight increase in viscosity results, and wherein the latex mixture possesses an ionic strength of from about 0.001 M to about 5 M;

heating the resulting mixture at a temperature of from about 45° C. to about 80° C. thereby enabling aggregation and coalescence of particles of resin and colorant simultaneously, followed by cooling, isolating, washing and drying, and wherein there results toner particles of from about 2 to about 20 microns in volume average diameter; a process for the preparation of toner comprising mixing an emulsion latex comprised of sodio sulfonated polyester resin particles and a colorant followed by the addition of a monocationic salt; and heating the resulting mixture thereby simultaneously causing aggregation and coalescence; a process wherein subsequent to coalescence the toner product mixture is cooled, followed by recovery of the toner product, washing and drying, and wherein the colorant is of submicron size; a process wherein the toner product mixture is recovered by cooling to about 25° C., and thereafter washing and drying is accomplished; a process wherein the colorant dispersion is prepared with a microfluidizer at from about 75° C. to about 85° C. for a duration of from about 1 hour to about 3 hours; and a process wherein the ionic strength is from about 0.01 to about 2 M.

Processes of the present invention are directed to dissipating a polar charged sulfonated polyester, and preferably a sodium sulfonated polyester resin in water with a homogenizer at about 40° C. to about 90° C. resulting in submicron polyester particles in the size diameter range of from about 30 to about 80 nanometers to form an emulsion latex, followed by aggregation and coalescence of the submicron emulsion particles, with submicron colorant particles using sodium chloride or similar chlorides as a coagulant, and where the aggregation/coalescence is conducted at a temperature o,f for example, about 2 to about 8 degrees below the resin Tg. In embodiments, the present invention is directed to a process with reduced surfactant amounts comprised of forming a latex of a polyester, such as a sodium sulfonated polyester resin in water, mixing the latex with a colorant dispersion containing a monocationic halide, such as sodium chloride, to form aggregates, and thereafter, heating the formed aggregates to enable the generation of coalesced toner particles. The enablement of aggregation/coalescence in a single sequence is thus permitted.

The polyester resin selected preferably contains sulfonated groups thereby rendering them dissipatable, that is, they form spontaneous emulsions without the use of organic solvents, in water above the glass transition temperature, Tg, of the polyester resin. Also, the process of the present invention can be considered a reduced surfactant method, or wherein no surfactant is needed, and thus minimal washing is employed, and wherein sulfopolyester particles are aggregated with monoionic salts, such as sodium chloride, under high shearing conditions followed by heating for coalescence, and wherein during the heating no surfactants are utilized. Heating the mixture about above or in embodiments equal to the resin Tg generates toner particles with, for example, a volume average diameter of from about 1 to about 25 and preferably about 2 to about 10 microns. It is believed that during the heating stage, the submicron resin and colorant particles aggregate and coalesce together in one single step to form the composite toner particle. Furthermore, the aggregation and coalescence is a continuous process, and therefore, a continuous growth in particle size is observed when heating at the aggregation temperature, the optimum temperature being in the range of about 40° C. to about 60° C. and preferably in the range of about 45° C. to about 55° C.

More specifically, the present invention is directed to an in situ process comprised of first dispersing a colorant, such as red, green, blue, and the like, and specifically HELIOGEN BLUE™ or HOSTAPERM PINK™, reference the Color Index, in an aqueous mixture utilizing a high shearing device, such as a Brinkmann Polytron, microfluidizer or sonicator, thereafter shearing this mixture with a latex of suspended polyester resin particles, and which particles are preferably, for example, of a size ranging from about 5 to about 300 nanometers in volume average diameter, as measured by the Brookhaven nanosizer. Thereafter, the mixture is contacted with a monocationic salt, such as sodium chloride, thereby resulting in a flocculation, or heterocoagulation of the resin particles with the colorant particles. The speed at which toner size aggregates are formed is primarily controlled by the temperature and by the amount of the monocationic salt such as sodium chloride, and the resulting in toner size can range from about 1 to about 20 microns and preferably in the range of from about 2 to about 10 microns, with a GSD of about 1.1 to about 1.4 and preferably in the range of about 1.14 to about 1.26. The aforementioned toners are especially useful for the development of colored images with excellent line and solid resolution, and wherein substantially no background deposits are present.

The present invention also resides in processes for the preparation of surfactant free chemical toners, wherein the washing of the toner particles is reduced or eliminated. The process of washing in the present invention is mainly for the purpose of removing any salts formed. Furthermore, the present invention resides in processes for the chemical or in situ preparation of a polyester toner thereby enabling the generation of glossy images with the toner. Of importance to the present invention is the ionic strength of the mixture as indicated herein.

In another embodiment the present invention is directed to the simultaneous aggregation and coalescence of the latex particles and the colorant particles, and wherein the process involves a continuous particle growing phase until the desired particle size is achieved, wherein the growth is terminated by quenching, or cooling the reactor contents, and wherein there are provided toner compositions with low fusing temperatures of from about 110° C. to about 150° C. and with excellent blocking characteristics at from about 50° C. to about 60° C.

Specifically, the present invention is directed to processes for the preparation of toner compositions which comprises initially attaining or generating a colorant dispersion, for example by dispersing an aqueous mixture of a colorant, such as a pigment or pigments, such as carbon black like REGAL 330® obtained from Cabot Corporation, phthalocyanine, quinacridone or RHODAMINE B™, and generally cyan, magenta, yellow, or mixtures thereof, by utilizing a high shearing device, such as a Brinkmann Polytron, thereafter shearing the colorant mixture utilizing a high shearing device, such as a Brinkmann Polytron, a sonicator or microfluidizer with a suspended resin mixture comprised of a sulfonated polyester polymer component, adding a monocationic salt or halide, such as sodium chloride, and the like to enable aggregation/coalescence of the resin and colorant particles to produce toner size particles in the range of from about 1 to about 20, more specifically from about 3 to about 10 microns, and more preferably in the range of from about 4 to about 9 micron with a narrow particle size distribution, which is in the range of from about 1.15 to about 1.25, and which aggregation is accomplished by heating at about 2 to about 5 degrees below the Tg of the sulfonated resin.

For example, the process of the present invention comprises preparing an emulsion latex comprised of sodio sulfonated polyester resin particles of preferably less than about 0.1 micron in size diameter, and for example, from about 5 to about 500, or more specifically, from about 100 to about 200 nanometers, and in an amount of from about 1 to about 5 weight percent by heating the resin in water at a temperature of, for example, from about 45° C. to about 90° C.; adding a predispersed colorant dispersion obtained from Sun Chemicals to the latex mixture, and subsequently adding a monocationic halide in an amount, for example, of from about 1 to about 2 weight percent in water until a slight increase in viscosity of from about 2 centipoise to about 100 centipoise results; cooling; and heating the resulting mixture below about the resin Tg, and more specifically, at a temperature of from about 45° C. to about 60° C. thereby causing aggregation and coalescence in one single step and resulting in toner particles of from about 2 to about 25, and more specifically, from about 4 to about 9 microns in size (volume average diameter) with a geometric distribution of less than about 1.25, and optionally quenching the product mixture to, for example, about 25° C., and wherein the mixture of salt, water, latex, and colorant possesses an important ionic strength of from about 0.001 M (molar) to about 5 M and preferably from about 0.01 M to about 2 M; followed by filtering and drying.

Yet more specifically, the present invention relates to the preparation of toner compositions comprising preparing an emulsion latex comprised of sodio sulfonated polyester resin particles of from about 5 to about 500 nanometers in size diameter by heating the resin in water at a temperature of from about 65° C. to about 90° C.; adding a pigment dispersion available from Sun Chemical to the latex mixture; adding a sodium chloride solution until a slight increase in the viscosity of from about 2 centipoise to about 100 centipoise results; heating the resulting mixture at a temperature of from about 45° C. to about 60° C. thereby enabling aggregation and coalescence simultaneously, resulting in toner particles of from about 4 to about 12 microns in volume average diameter and with a geometric distribution of less than about 1.25; and optionally quenching the product mixture to about 25° C. and subsequently isolating, filtering and drying; the surfactant free preparation of toner compositions comprising preparing an emulsion latex comprised of sodio sulfonated polyester resin particles of less than about, or equal to about 0.1 micron in size by heating the resin in water a temperature of from about 15° C. to about 30° C. above its glass transition temperature; mixing with a pigment dispersion available from Sun Chemicals with shearing, and subsequently adding a monocationic salt in an amount, for example, of from about 1 to about 2 weight percent in water until gellation occurred as indicated, for example, by an increase in viscosity of from about 2 centipoise to about 100 centipoise; heating the resulting mixture below about the resin Tg at a temperature of from about 45° C. to about 60° C. thereby enabling aggregation and coalescence and quenching, or cooling the product mixture with water to about 25° C., followed by filtering and drying; and the preparation of toner compositions comprising preparing an emulsion latex comprised of sodio sulfonated polyester resin particles by heating said resin in water; adding a pigment dispersion to a latex mixture comprised of sulfonated polyester resin particles in water with shearing, followed by the addition of a monocationic salt; and heating the resulting mixture thereby enabling simultaneous aggregation and coalescence.

Colorants, such as pigments available in the wet cake form or concentrated form, containing water can be easily dispersed utilizing a homogenizer or stirring. Pigments are available in a dry form, whereby dispersion in water is preferably effected by microfluidizing using, for example, a M-110 microfluidizer and passing the pigment dispersion from about 1 to about 10 times through the chamber of the microfluidizer, or by sonication, such as using a Branson 700 sonicator, or use predispersed pigments available from companies such as Sun Chemicals, Hoechst, and the like.

The preferred latex resin is a sulfonated polyester, examples of which include those as illustrated in copending application U.S. Ser. No. 221,595, the disclosure of which is totally incorporated herein by reference, such as a sodio sulfonated polyester, and more specifically, a polyester, such as poly(1,2-propylene-sodio 5-sulfoisophthalate), poly (neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene-sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), copoly(propoxylated bisphenol A)-copoly-(propoxylated bisphenol A-sodio 5-sulfoisophthalate) bisphenylene, bis(alkyloxy) bisphenolene, and the like. The sulfopolyester possesses a number average molecular weight ($M_n$) of, for example, from about 1,500 to about 50,000 grams per mole, and a weight average molecular weight ($M_w$) of, for example, from about 6,000 grams per mole to about 150,000 grams per mole as measured by gel permeation chromatography and using polystyrene as standards.

Various known colorants present in the toner in an effective amount of, for example, from about 1 to about 25 percent by weight of the toner, and preferably in an amount of from about 2 to about 12 weight percent that can be selected include carbon black like REGAL 330®; magnetites, such as Mobay magnetites MO8029™, MO08060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™available from E.I. DuPont de Nemours & Company, and the like. Generally, colorants that can be selected are cyan, magenta, or yellows, and mixtures thereof. Examples of magentas are 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyans include copper tetra (octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; and illustrative examples of yellows pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo4'-chloro-2,5-dimethoxy acetoacetanilide, and Permanent Yellow FGL. Colored magnetites, such as mixtures of MAPICO BLACK™ and cyan components, may also be selected as pigments with the process of the present invention.

Colorant includes dyes, pigments, mixtures thereof, mixtures of pigments, mixtures of dyes, and the like.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surface additives that can be added to the toner compositions after washing or drying include, for example, metal salts, metal salts of fatty acids, colloidal silicas, metal oxides, mixtures thereof, and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and silicas, such as those available from Cabot Corporation and Degussa Chemicals, and more specifically, AEROSIL R972® available from Degussa, each in amounts of from about 0.1 to about 2, or more specifically, from about 0.9 to about 1.5 percent which can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. Also, for the developers there can be selected carrier particles with a core and a polymer thereover of, for example, polymethylmethacrylate with a conductive component, such as carbon black, dispersed therein.

Imaging methods are also envisioned with the toners of the present invention, reference for example a number of the patents mentioned herein, and U.S. Pat. No. 4,265,660; 4,585,884; 4,584,253, and 4,563,408, the disclosures of which are totally incorporated herein by reference.

The following Examples are being provided. These Examples are intended to be illustrative only and are not intended to limit the scope of the present invention. Also, parts and percentages are by weight and wherein the total of the solids is about 100 percent unless otherwise indicated. Comparative Examples and data are also provided.

PREPARATION OF SULFONATED POLYESTERS

Preparation of Linear Moderately Sulfonated Polyester A (DF209):

A linear sulfonated random copolyester resin comprised of, on a mol percent, 0.465 of terephthalate, 0.035 of sodium sulfoisophthalate, 0.475 of 1,2-propanediol, and 0.025 of diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethyl sulfoisophthalate, 310.94 grams of 1,2-propanediol (1 mole excess of glycols), 22.36 grams of diethylene glycol (1 mole excess of glycols), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol were collected. The reactor was then purged with nitrogen to atmospheric pressure, and the polymer product discharged through the bottom drain onto a container cooled with dry ice to yield 460 grams of 3.5 mol percent sulfonated-polyester resin, copoly(1,2-propylene-diethylene)terephthalate-copoly(sodium sulfoisophthalate dicarboxylate). The sulfonated-polyester resin glass transition temperature was measured to be 59.5° C. (onset) utilizing the 910 Differential Scanning Calorimeter available from E.I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

Submicron latex dispersions of the above sulfonated polyester in distilled deionized water were prepared by first heating the water to 65° C., (10° C. to 15° C. above the glass transition of the sulfonated polyester polymer), and then slowly adding the polymer with stirring until it has fully dispersed. The latex has a characteristic blue tinge and was found to have a particle size of 31 nanometers (volume weighted) and was measured using a Nicomp particle sizer. These stock solutions were found to be stable indefinitely.

Preparation of Latex Stock Solutions:

1,000 Grams of deionized water were heated to 65° C. (Centigrade throughout) after which 250 grams of the above sulfonated polyester were slowly introduced and heated for 1 hour at 65° C., until the polymer was fully dispersed. The latex had a characteristic blue tinge and was found to have a particle size of 57 nanometers (volume weighted) as measured using a Nicomp particle sizer. These stock solutions were found to be stable indefinitely.

EXAMPLE I

400 Milliliters of the above emulsion was placed in a 1 liter reaction kettle and 5.8 grams of the pigment dispersion (40 percent solids) of Cyan 15.3 was introduced. The latex pigment mixture was polytroned while 125 milliliters of a 5 percent solution of NaCl (of an ionic strength of 0.856 M) in water was added, and the ionic strength of the resulting mixture increased from 0.045 M to 0.238 M. Upon completion of the salt addition, the kettle was placed in an oil bath and the mixture heated to 45° C. with stirring. After 6 hours, the particle size had grown to 1 micron and were observed to be coalesced. The ionic strength of the mixture was further increased to 0.292 M by adding an additional 50 milliliters of a 5 percent NaCl solution and the temperature raised to 50° C. Stirring overnight, about 18 hours, was accomplished. The toner particle morphology was spherical in nature. The toner was filtered and washed with 2 liters of water twice to remove any salt residue and dried. The toner particle size resulting was 6.5 microns (volume average diameter) and the toner GSD was 1.18. The molecular weight of the toner resin was identical to the starting latex resin. Tg onset was 54.5° C. and the midpoint Tg was 59.5° C. The rheology of the toner showed no increase in viscosity. This indicated no reinforcement or crosslinking by the addition of the monovalent salt.

Ionic strength $I=\frac{1}{2}[(m+)(z+)2+(m-)(z-)2]$ where m is the molality (i.e. the number of moles of solute dissolved in 1 kilogram of solvent) and z is the charge on the ion (i.e. Na+=1), and the molality is multiplied by the square of the charge of the ion. Thus, for a 5 weight percent NaCl solution which is 5 grams of dissolved NaCl in 100 grams of water solvent.

The moles of NaCl are 5 g/158.45 g/m=0.0856 moles;

thus the molality is 0.0856 mol/0.1 kilogram=0.856 mol/kilogram; and the molality is 0.0856 mol/0.100 liter=0.856 mol/liter.

The morality of the polymer is based on the repeat unit of the polymer, which is the situation for the above polyester with an average molecular weight of 194 grams/m, thus 250 grams of polymer dissipated into one liter of water is equal to 0.774 mols of polymer, and since this 0.774 mols of polymer contain 3.5 mol percent of sulfonate groups, this is equal to 0.045 mols of sulfonate groups. In one liter then, based on the above formula, the molality is:

0.045 mol/1.0 kilogram=0.045 mol/kilogram; and the morality is 0.045 mol/liter.

In the above Example, above the ionic strength changes are

Polymer contribution+Added sodium chloride=Total ionic strength;

Polymer Ionic strength×dilution factor+NaCl ionic strength×dilution factor=ionic strength of mixture, for example,

[(0.45 M)×(400 ml/525 ml)(total volume in first addition)]+[(0.856M)×(125 ml/525 ml)=0.238 M.

EXAMPLE II

400 Milliliters of the above emulsion were placed in a 1 liter reaction kettle and 23 grams of the pigment dispersion (30 percent solids) of Yellow 180 were introduced. The latex pigment mixture was polytroned while 125 milliliters of a 5 percent solution of NaCl (of an ionic strength of 0.856 M) in water were added, and the ionic strength of the mixture increased from 0.045 M to 0.238 M. Upon completion of the salt addition, the kettle was placed in an oil bath and the mixture heated to 45° C. with stirring. After 5 hours, the particle size had grown to 1.5 microns and was observed to be coalesced. The ionic strength of the mixture resulting was further increased to 0.320 M by adding an additional 80 milliliters of a 5 percent NaCl solution and the temperature raised to 50° C., followed by stirring for 5 hours and cooling. The toner was filtered and washed with 2 liters of water twice to remove any salt residue, and dried. The particle size obtained was 5.9 microns with a GSD of 1.17. The molecular weight of the toner resin was identical to the starting resin. Toner Tg onset was 54.8° C., and the midpoint Tg was 58.5° C. The rheology of the toner showed no increase in viscosity. This indicated no reinforcement or crosslinking by the addition of the monovalent salt.

EXAMPLE III

400 Milliliters of the above emulsion were placed in a 1 liter reaction kettle and 17 grams of the pigment dispersion (30 percent solids) of carbon black Black 7 were introduced. The latex pigment mixture was polytroned while 125 milliliters of a 5 percent solution of NaCl (of an ionic strength of 0.856 M) in water were added, and the ionic strength of the mixture increased from 0.045 M to 0.238 M. Upon completion of the salt addition, the kettle was placed in an oil bath and the mixture heated to 45° C. with stirring. After 5 hours, the particle size had grown to 2.1 microns and were observed to be coalesced. The ionic strength of the mixture was further increased to 0.324 M by adding an additional 90 milliliters of a 5 percent NaCl, and the temperature raised to 50° C., followed by stirring the mixture for 5 hours and cooling. The toner was filtered and washed with 2 liters of water twice to remove any salt residue, and dried. The toner particle size obtained was 6.3 microns with a GSD of 1.16. The molecular weight of the toner resin was identical to the starting latex resin. Tg onset was 54.1° C. and the midpoint Tg was 58.3° C. The rheology of the toner material showed no increase in viscosity. This indicated no reinforcement or crosslinking by the addition of the monovalent salt.

EXAMPLE IV

100 Grams of sulfonated polyester resin DF214 prepared in a similar manner as the Example I DF209 were dissipated in 400 milliliters of hot water at 65° C. The particle resin size obtained was 60 nanometers measured with a Nicomp particle size analyzer. 17 Grams of the pigment dispersion (30 percent solids) of Red 81.3 were then introduced into the latex mixture. The resulting latex pigment mixture was polytroned while 135 milliliters of a 5 percent solution of NaCl (of an ionic strength of 0.856 M) in water were added, and the ionic strength of the mixture increased from 0.045 M to 0.240 M. Upon completion of the salt addition, the kettle was placed in an oil bath and the mixture heated to 45° C. with stirring. After 4 hours, the particle size had grown to 1.4 microns and was observed to be coalesced. The ionic strength of the mixture was increased to 0.324 M by adding an additional 75 milliliters of a 5 percent NaCl solution, and the temperature raised to 50° C. and stirred for 4.5 hours, followed by cooling. The toner was filtered and washed with 2 liters of water twice to remove any salt residues, and dried. The toner particle size obtained was 6.2 microns with a GSD of 1.18. The molecular weight of the toner resin was identical to the starting latex resin. The Tg onset of the toner resin was 54.2° C. and the midpoint Tg was 59.6° C. The rheology of the toner material showed no increase in viscosity. This indicated no reinforcement or crosslinking by the addition of the monovalent salt.

EXAMPLE V

Comparative Stepwise Aggregation:

100 Grams of the above prepared sulfonated polyester resin DF209 was dissipated in 400 milliliters of hot water at 65° C. The particle size obtained was 31 nanometers measured with a Nicomp particle size analyzer (used throughout for measuring size). A 186 milliliters of a 1 percent solution of the dicationic salt $MgCl_2$ (of an ionic strength of 0.315 M) in water were added, and the ionic strength of the mixture increased from 0.045 M to 0.13 M. Upon completion of the salt addition, the kettle was placed in an oil bath and the mixture heated to 45° C. with stirring for 3 hours. The particle size of the latex had grown from 30 to 120 nanometers. Thirty (30) grams of the above yellow 18° pigment dispersion (Sun Chemical 40 percent solids) with a mean pigment size of 90 nanometers were further dispersed with a 150 milliliters of distilled deionized water, and were then added to the latex particles. 133 Milliliters more of the 1 percent $MgCl_2$ were added dropwise to the solution, increasing the ionic strength to 0.165 M and the temperature held at about 50° C. for 5 hours, followed by cooling. The growth in pigmented particles was clearly visible in a laboratory microscope and the particle size, as measured on a Coulter Counter, was 3.0 microns. An additional 20 milliliters of the 1 percent $MgCl_2$ solution were added dropwise, further increasing the ionic strength to 0.16 M, and the temperature increased to 52° C. After 2 hours, a sample, about one gram, was removed and observed under a microscope which revealed spherical particles containing both pigment and polymer. The toner was filtered and washed with 2 liters of water twice to remove any salt residue, and dried. A final yellow toner partide size of 5.0 microns with a GSD of 1.3 resulted with the yellow toner being comprised of 92.0 weight percent of the sulfonated polyester and 8.0 weight percent of the above yellow pigment. The molecular weight of the toner resin was identical to the starting latex resin. The Tg onset of the toner resin was 49° C. and the midpoint Tg was 53° C.

The comparative toner when measured under similar conditions showed that the viscoelastic behavior was very similar to those materials that are crosslinked, indicating that the use of divalent salts, such as magnesium chloride, as a coagulant results in bridging network of polyester and the divalent cationic salts, and hence reinforcement. These toners are fused when matte toner finishes are desired.

All of the above samples, including the Comparative sample, were tested on the Rheometerics Mechanical spectrometer where the viscoelastic response is measured as a function of temperature and plotted at a constant frequency of 1 radisecond. Polyester samples prepared using monovalent cationic salts, such as NaCl, decreased the melt viscosity about 3 orders of magnitude in the temperature range of the experiment, which was between 80° C. and 180° C., indicating no reinforcement or crosslinking was present. These toners can be used to obtain glossy images since no crosslinking is present.

Other embodiments and modifications of the present invention may occur to those of ordinary skill in the art subsequent to a review of the present application and the information presented herein; these embodiments, modifications, and equivalents, or substantial equivalents thereof, are also included within the scope of this invention.

What is claimed is:

1. A process for the preparation of toner comprising mixing an emulsion latex, a colorant dispersion, and monocationic salt, and which mixture possesses an ionic strength of from about 0.001 molar (M) to about 5 molar, and optionally cooling.

2. A process in accordance with claim 1 wherein the latex contains a sodio sulfonated polyester resin of from about 5 to about 500 nanometers in size diameter, a solution of the monocationic salt is added to the latex and colorant mixture, and cooling is accomplished.

3. A process in accordance with claim 1 wherein said emulsion latex contains a resin, and which latex is prepared by heating said resin in water at a temperature of from about 65° C. to about 90° C.; thereafter there is added said colorant dispersion with shearing, followed by the addition to said resulting mixture of said monocationic salt until there results an increase in the latex viscosity of from about 2 centipoise to about 100 centipoise, and which mixture possesses an ionic strength of from about 0.001 to about 5 M; heating the resulting mixture at a temperature of from about 45° C. to about 80° C. thereby enabling the simultaneous aggregation and coalescence of particles of resin and colorant resulting in toner of from about 2 to about 20 microns in volume average diameter with the size of the toner being retained upon quenching, or cooling the product mixture, followed by filtration and drying.

4. A process in accordance with claim 2 wherein the salt is sodium chloride, potassium chloride, sodium bromide, or potassium bromide.

5. A process in accordance with claim 3 wherein the ionic strength of the monocationic salt and the temperature of the aggregation/coalescence controls the final toner particle size, and which size is from about 4 to about 10 microns, and wherein said shearing is completed by homogenizing at from about 1,000 revolutions per minute to about 10,000 revolutions per minute, at a temperature of from about 25° C. to about 35° C., and for a duration of from about 1 minute to about 120 minutes.

6. A process in accordance with claim 3 wherein the colorant dispersion is generated by microfluidization in a microfluidizer, or in nanojet for a duration of from about 1 minute to about 120 minutes.

7. A process in accordance with claim 3 wherein shearing or homogenization is accomplished by homogenizing at from about 1,000 revolutions per minute to about 10,000 revolutions per minute for a duration of from about 1 minute to about 120 minutes.

8. A process in accordance with claim 1 wherein the emulsion latex contains a resin of (i) a polyester of poly(1,2-propylene-sodio 5-sulfoisophthalate), poly(neopentylene-sodio 5-sulfoisophthalate), poly(diethylene-sodio 5-sulfoisophthalate), copoly (1,2-propylene-sodio 5-sulfoisophthalate)-copoly-(1,2-propylene-terephthalatephthalate), copoly(1,2-propylene-diethylene-sodio 5-sulfoisophthalate)-copoly-(1,2-propylene-diethylene-erephthalatephthalate), copoly-(ethylene-neneopentylene-sodio 5-sulfoisophthalate)-copoly-(ethylene-neopentylene-terephthalate-phthalate), or copoly (propoxylated bisphenol A)-copoly-(propoxylated bisphenol A-sodio 5-sulfoisophthalate); and wherein the salt is sodium chloride, potassium chloride, sodium bromide, or potassium bromide.

9. A process in accordance with claim 2 wherein the emulsion latex contains a resin of (i) a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalatephthalate), copoly(1,2-propylene-diethylene-sodio 5-sulfoisophthalate)-copoly-(1,2-propylene-diethylene-terephthalatephthalate), copoly(ethylene-neopentylene-sodio 5-sulfoisophthalate)-copoly-(ethylene-neopentylene-terephthalate-phthalate), or copoly (propoxylated bisphenol A)-copoly-(propoxylated bisphenol A-sodio 5-sulfoisophthalate).

10. A process in accordance with claim 2 wherein the colorant is carbon black, cyan, yellow, magenta, and mixtures thereof.

11. A process in accordance with claim 3 wherein the resin is from about 0.01 to about 0.2 micron in volume average diameter, and the colorant in the form of particles is from about 0.01 to about 500 nanometers in volume average diameter.

12. A process in accordance with claim 2 wherein the toner particles isolated are from about 2 to about 15 microns in volume average diameter, and the geometric size distribution thereof is from about 1.15 to about 1.35.

13. A process in accordance with claim 2 wherein there is added to the surface of the formed toner metal salts, metal salts of fatty acids, silicas, metal oxides, or mixtures thereof, each in an amount of from about 0.1 to about 10 weight percent of the obtained toner particles.

14. A process in accordance with claim 3 wherein the toner obtained after quenching is from about 3 to about 15 microns in volume average diameter, and the geometric size distribution thereof is from about 1.15 to about 1.30.

15. A process in accordance with claim 3 wherein the resin Tg is from about 50° C. to about 65° C.

16. A process for the preparation of toner comprising mixing an emulsion latex comprised of sodio sulfonated polyester resin particles of less than about 0.1 micron in size diameter by heating said resin particles in water at a temperature of from about 15° C. to about 30° C. above the resin glass transition temperature and a colorant dispersion followed by the addition of a monoatomic halide until an increase in viscosity results, and wherein the latex mixture possesses an ionic strength of from about 0.001 M to about 5 M;

heating the resulting mixture at a temperature of from about 45° C. to about 80° C. thereby enabling aggregation and coalescence of particles of resin and colorant simultaneously, followed by cooling, isolating, washing and drying, and wherein there results toner particles of from about 2 to about 20 microns in volume average diameter.

17. A process for the preparation of toner comprising mixing an emulsion latex comprised of sodio sulfonated polyester resin particles, a colorant and a monocationic salt; and heating the resulting mixture thereby simultaneously causing aggregation and coalescence.

18. A process in accordance with claim 17 wherein subsequent to coalescence the toner product mixture is cooled, followed by recovery of the toner product, washing and drying, and wherein the colorant is of submicron size.

19. A process in accordance with claim 18 wherein the toner product mixture is recovered by cooling to about 25° C., and thereafter there is accomplished said washing and said drying.

20. A process in accordance with claim 2 wherein the colorant dispersion is prepared with a microfluidizer at from about 75° C. to about 85° C. for a duration of from about 1 hour to about 3 hours.

21. A process in accordance with claim 2 wherein subsequent to cooling the toner resulting is cooled to about 25° C., followed by washing and drying.

22. A process in accordance with claim 1 wherein said ionic strength is from about 0.01 to about 2 M.

23. A process in accordance with claim 2 wherein said ionic strength is from about 0.01 to about 2 M.

24. A process in accordance with claim 1 wherein said monocationic salt is sodium chloride.

25. A process in accordance with claim 24 wherein said sodium chloride is added in a solution thereof, and wherein said solution possesses an ionic strength of about 0.856 molar.

26. A process for the preparation of toner consisting essentially of mixing an emulsion latex, a colorant dispersion, and monocationic salt, and which mixture possesses an ionic strength of from about 0.001 molar (M) to about 5 molar.

27. A process in accordance with claim 26 wherein said monocationic salt is sodium chloride, sodium bromide, sodium iodide, potassium chloride or potassium bromide.

28. A process in accordance with claim 26 wherein said monocationic salt is sodium chloride.

29. A process in accordance with claim 1 wherein said emulsion latex is comprised of water and a resin.

30. A process in accordance with claim 1 wherein said emulsion latex contains a resin of copoly(1,2-propylene-diethylene)terephthalate-copoly(sodium sulfoisophthalate dicarboxylate).

* * * * *